United States Patent [19]

Miyakawa et al.

[11] 4,395,112

[45] Jul. 26, 1983

[54] LATENT ELECTROSTATIC IMAGE DEVELOPING DEVICE

[75] Inventors: Nobuhiro Miyakawa, Suita; Kiyoshi Shibata, Osaka; Toshio Watanabe, Takatsuki; Yosuke Ohata, Habikino, all of Japan

[73] Assignee: Mita Industrial Co., Ltd., Japan

[21] Appl. No.: 300,525

[22] Filed: Sep. 9, 1981

[30] Foreign Application Priority Data

Sep. 19, 1980 [JP] Japan ..... 55-131073

[51] Int. Cl.[3] ..... G03G 15/00

[52] U.S. Cl. ..... 355/14 D; 355/3 DD; 118/647

[58] Field of Search ..... 355/3 DD, 3 TR, 3 CH, 355/14 D, 3 R; 118/647, 651; 307/149; 361/235

[56] References Cited

U.S. PATENT DOCUMENTS

| | | | |
|---|---|---|---|
| 2,919,672 | 1/1960 | Benn et al. | 355/3 DD X |
| 3,677,632 | 7/1972 | MacDonald, Jr. | 355/3 R |
| 3,814,516 | 6/1974 | Whited | 355/3 DD |
| 3,816,756 | 6/1974 | Bresnick | 307/149 |
| 3,877,416 | 4/1975 | Donohue | 355/3 TR X |
| 4,194,830 | 3/1980 | Ohnuma et al. | 355/3 DD |
| 4,314,755 | 2/1982 | Kinashi | 355/3 DD X |

*Primary Examiner*—A. C. Prescott

*Attorney, Agent, or Firm*—Beveridge, De Grandi & Kline

[57] ABSTRACT

A latent electrostatic image developing device for developing a latent electrostatic image formed on an image-bearing member by applying a developer thereto. The developing device comprises a developer applicator means for holding the developer on its surface, carrying the developer to a developing zone and applying it to the latent electrostatic image in the developing zone and a bias voltage applying means for applying a bias voltage to the developer held on the surface of the developer applicator means. The developing device further includes a detector means for detecting the relative humidity of the environmental atmosphere and a control means for changing the magnitude of the applied bias voltage to a lower value when the detected relative humidity of the atmosphere exceeds a predetermined value.

4 Claims, 2 Drawing Figures

LATENT ELECTROSTATIC IMAGE DEVELOPING DEVICE

FIELD OF THE INVENTION

This invention relates to a latent electrostatic image developing device, and more specifically, to a developing device for developing a latent electrostatic image formed on an image-bearing member by applying a developer thereto.

DESCRIPTION OF THE PRIOR ART

A developing device for developing a latent electrostatic image formed on an image-bearing member such as a photosensitive member in an electrostatic copying machine or the like generally comprises a developer applicator means for holding a developer on its surface, carrying the developer to a developing zone and applying it to the latent electrostatic image in the developing zone. In the developing zone, the developer held on the surface of the developer applicator means is attracted to the image-bearing member by the electrostatic charge of the latent electrostatic image, and adheres thereto according to the charge pattern of the latent electrostatic image, thereby developing the latent electrostatic image.

It is well known to those skilled in the art that when the image-bearing member is a photosensitive member to be used repeatedly, an electrostatic charge exists on image areas (i.e., areas to which the developer is to adhere) of the latent electrostatic image on the image-bearing member, and for various reasons, some amount of electrostatic charge tends to remain also on the non-image areas (i.e, areas to which the developer should not adhere) of the latent electrostatic image. This residual electrostatic charge causes some amount of the developer to adhere also to the nonimage areas of the latent electrostatic image during development, and results in a tendency toward occurrence of undesired "fogging" in the developed image.

The present practice for avoiding this fogging tendency is to apply a bias voltage to the developer held on the surface of the developer applicator means by grounding the image-bearing member and connecting a dc bias voltage supply between the developer applicator means and the ground. The bias voltage counteracts the action of the residual electrostatic charge and prevents occurrence of fogging.

It has been found that with a developing device adapted to apply a bias voltage to the developer held on the surface of the developer applicator means, a quality visible image can be obtained without fogging when the relative humidity of the environmental atmosphere is within a certain range, but that considerable variations in the relative humidity of the atmosphere would give rise to problems to be solved, such as a lack of development and occurrence of some amount of fogging.

SUMMARY OF THE INVENTION

It is an object of this invention to provide a novel and improved device for developing a latent electrostatic image, which can give developed images of good quality stably without causing undesirable phenomena such as the lack of development or the occurrence of fogging even when the relative humidity of the environmental atmosphere varies considerably.

The present inventors have extensively made investigations and conducted experiments about the aforesaid problems associated with conventional latent electrostatic image developing devices, and ascertained the following fact.

When the relative humidity of the atmosphere rises, the electrostatic charge on the image-bearing member increasingly leaks into the atmosphere. Hence, the amount of electrostatic charge in the image areas of the latent electrostatic image on the image-bearing member tends to decrease and the amount of the residual charge in the nonimage areas of the latent electrostatic image tends to decrease. Conversely, when the relative humidity of the atmosphere decreases, leakage of the electrostatic charge on the image-bearing member into the atmosphere is reduced. Accordingly, the amount of the electrostatic charge in the image areas of the latent electrostatic image formed on the image-bearing member and the amount of the residual charge in its non-image areas increases. In conventional latent electrostatic image developing devices, the magnitude of the bias voltage is always constant despite the fact that the amounts of the electrostatic charge in the image areas and the residual electrostatic charge in the non-image areas of the latent electrostatic image change with a change in the relative humidity of the atmosphere. Generally, developed images of good quality free from undesirable phenomena such as fogging can be obtained when the voltage attributed to the residual electrostatic charge in the non-image areas of the latent electrostatic image is substantially equal to, or slightly lower than, the bias voltage. However, when the amount of the electrostatic charge in the image areas and the amount of the residual electrostatic charge in the non-image areas decrease as above with an increase in the relative humidity of the atmosphere, the bias voltage always kept constant becomes higher than the voltages ascribable to these electrostatic charges. Consequently, the action of the residual charge in the non-image areas is set off, and the action of the electrostatic charge in the image areas is reduced excessively, leading to a lack of development. If, on the other hand, the relative humidity of the atmosphere decreases to increase the amount of the electrostatic charge in the image areas and the amount of the residual electrostatic charge in the non-image areas, the bias voltage kept always constant becomes lower than the voltages ascribable to these charges. Accordingly, the action of the residual charge in the non-image areas cannot be sufficiently set off, and some amount of fogging occurs.

The recognition of the above fact in regard to the problems residing with conventional latent electrostatic image developing devices has led the present inventors to the conclusion that if measures are taken to change the magnitude of the bias voltage with changes in the relative humidity of the atmosphere, the aforesaid problems would be solved, and developed images of good quality would be able to be obtained stably without the occurrence of undesirable phenomena such as the lack of development or fogging upon considerable variations in the relative humidity of the atmosphere.

According to this invention, there is provided a latent electrostatic image developing device for developing a latent electrostatic image formed on an image-bearing member by applying a developer thereto, said developing device comprising a developer applicator means for holding the developer on its surface, carrying the developer to a developing zone and applying it to the latent electrostatic image in the developing zone and a bias voltage applying means for applying a bias voltage to the developer held on the surface of the developer applicator means; characterized in that the developing device further includes a detector means for detecting the relative humidity of the environmental atmosphere and a control means for changing the magnitude of the applied bias voltage according to the detected relative humidity of the atmosphere.

DETAILED DESCRIPTION OF THE PREFERRED EMBODIMENTS

A specific embodiment of the improved latent electrostatic image developing device of the invention is described below in detail with reference to the accompanying drawings.

Figure 1:
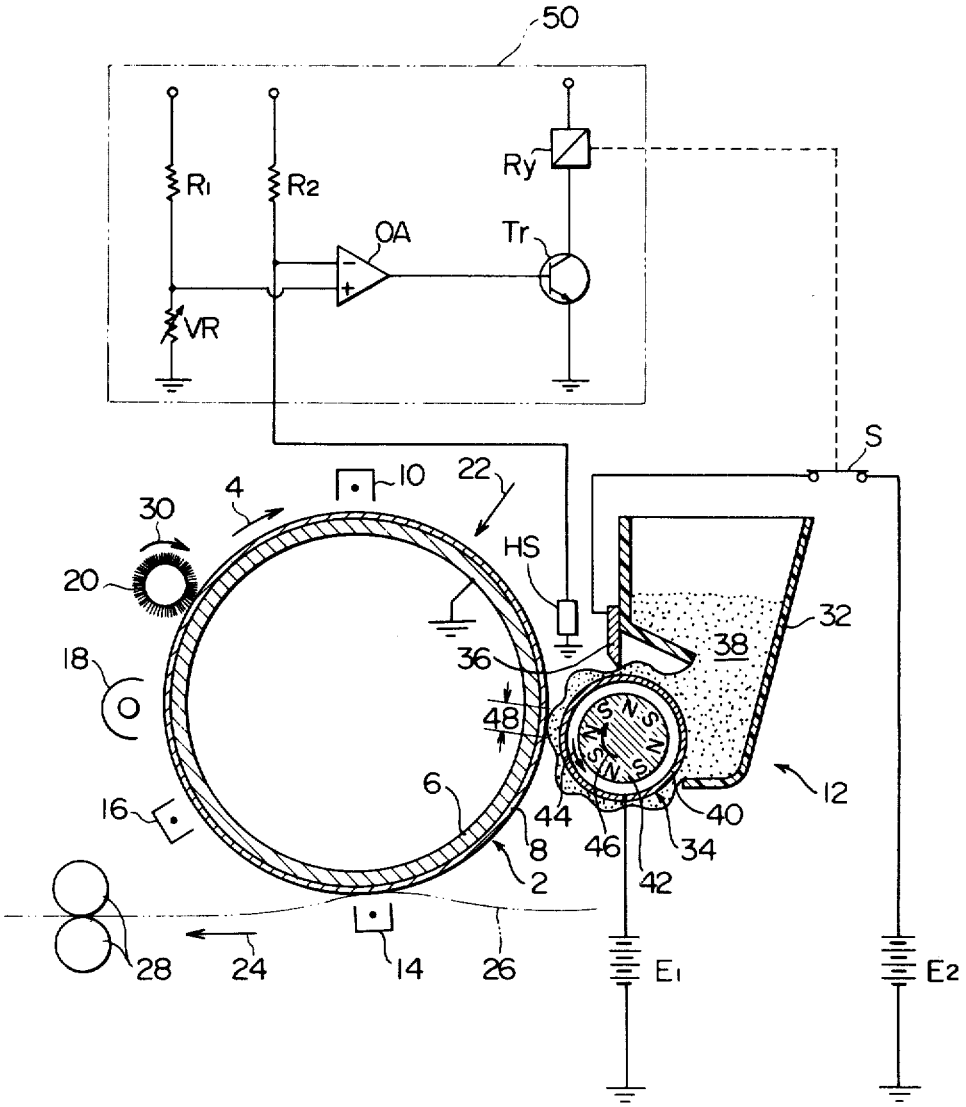
FIG. 1 is a simplified view of an electrostatic copying machine provided with one embodiment of the latent electrostatic image developing device of the invention.

Referring to FIG. 1 which shows in a simplified manner the principal parts of an electrostatic copying machine provided with one embodiment of the improved developing device of the invention, the electrostatic copying machine includes a rotating drum 2 provided for rotation in the direction of an arrow 4. The rotating drum 2 has a grounded conductive substrate 6 and an image-bearing member or photosensitive member 8 disposed thereon. Around the rotating drum 2 are located a charging corona discharge device 10, the improved developing device of the invention shown generally at 12, a transferring corona discharge device 14, a charge-eliminating corona discharge device 16, a charge-eliminating lamp 18 and a cleaning brush 20 arranged successively in the rotating direction shown by arrow 4 of the rotating drum 2.

While the rotating drum 2 is rotated in the direction of arrow 4, the charging corona discharge device 10 applies a corona discharge current of, for example, positive polarity to the photosensitive member 8 to charge it to a positive polarity. Then, by the action of a suitable optical unit (not shown), the image of an original document to be copied is projected onto the photosensitive member 8 as shown by an arrow 22 to form a latent electrostatic image corresponding to the image of the original document on the photosensitive member 8. Subsequently, a developer is applied to the latent electrostatic image on the photosensitive member 8 by the developing device 12 to develop it into a visible image. In a transfer zone where the transferring corona discharge device 14 is disposed, the surface of a copy sheet 26 shown by a two-dot chain line conveyed in the direction of an arrow 24 in synchronism with the rotation of the rotary drum 2 is brought into contact with the surface of the photosensitive member 8. The transferring corona dischage device 14 applies a corona discharge current of, for example, positive polarity to the back surface of the copy sheet 26 whereby the developed image on the photosensitive member 8 is transferred to the surface of the copy sheet 26. The copy sheet 26 having the developed image transferred thereto is separated from the surface of the photosensitive member 8 and sent to a fixing device which, for example, has a pair of heated rollers 28, and by the action of the ficing device, the developed image is fixed. Thereafter, the copy sheet 26 having the fixed image is discharged from the electrostatic copying machine. In the meantime, the rotating drum 2 keeps rotating, and during this rotation, the residual charge on the photosensitive member 8 is removed by the action of the charge-eliminating corona discharge device 16 adapted, for example, to apply an ac corona discharge current to the surface of the photosensitive member 8 and the action of the charge-eliminating lamp 18 which irradiates light onto the photosensitive member 8. The residual developer on the photosensitive member 8 is removed by the action of the cleaning brush 20 which is totated in the direction shown by an arrow 30.

The aforesaid structure of the illustrated electrostatic copying machine is only an example in electrostatic copying machines in which the developing device 12 of the invention can be used, and is already known to those skilled in the art. A description of the details of the above structure of the illustrated electrostatic copying machine is therefore omitted in the present specification.

The latent electrostatic image developing device 12 of the invention includes a developer dispenser 32, a developer applicator means 34 and a brush length setting member 36. The developer dispenser 32 may be made of a suitable material such as a synthetic resin. It dispenses a developer 38 included therein to the developer applicator means 34 through an opening located opposite to the developer applicator means 34. The developer 38 in the dispenser 32 may be a one-component developer consisting only of conductive or semiconductive magnetic toner particles. The developer applicator means 34 comprises a sleeve 40 which may be made of a conductive material and a roll-like permanent magnet 42 disposed within the sleeve 40. The permanent magnet 42 has a plurality of peripherally aligned magnetic poles, i.e. alternatively aligned N and S poles. The sleeve 40 is rotated in the direction of an arrow 44, and the permanent magnet 42, in the direction shown by an arrow 46. By the action of a magnetic field generated by the roll-like permanent magnet 42, the developer applicator means 34 magnetically holds the developer 38 supplied from the dispenser 32 onto the surface of the sleeve 40. The developer 38 is carried to a developing zone 48 by the rotation of the sleeve 40 in the direction of arrow 44 to bring it into contact with the surface of the photosensitive member 8. As a result, the developer 38 is attracted and adhered to the surface of the photosensitive member 8 by the action of the electrostatic charge of the latent electrostatic image formed on the photosensitive member 8 to develop the latent image to a visible image (toner image), as is well known to those skilled in the art. The brush length setting member 36 which may be made of a conductive material has a tip located in proximity to the surface of the sleeve 40 with a predetermined distance, and adjusts to a desired value the thickness of a layer of the developer 38 which has been carried to the developing zone 48 while being held on the surface of the sleeve 40.

The aforesaid structure of the latent electrostatic image developing device 12 shown in the drawing is only an example of the improved latent electrostatic image developing device of the invention and is already known to those skilled in the art. In the illustrated developing device 12, however, the following improvements have been incorporated in accordance with this invention.

The illustrated developing device 12 includes a bias voltage applying means having a first dc fixed voltage supply $E_1$ and a second dc fixed voltage supply $E_2$. The first dc fixed voltage supply $E_1$ is connected at its positive terminal to the sleeve 40 and grounded at its negative terminal. The second dc fixed voltage supply $E_2$ is connected at its positive terminal to the brush length setting member 36 through a normally closed switch S, and is grounded at its negative terminal. If desired, both the positive terminal of the first dc voltage supply $E_1$ and the positive terminal of the second dc voltage supply $E_2$ may be connected to the sleeve 40, or both the positive terminal of the first dc voltage supply $E_1$ and the positive terminal of the second dc voltage supply $E_2$ may be connected to the brush length setting member 36. Alternatively, it is possible to connect the positive terminal of the first dc voltage supply $E_1$ directly to the brush length setting member 36 and connect the positive terminal of the second dc voltage supply $E_2$ to the sleeve 40 through the switch S.

The illustrated developing device 12 further comprises a humidity detector HS for detecting the relative humidity of the environmental atmosphere and a bias voltage control means 50 for controlling the switch S on the basis of the relative humidity detected by the humidity detector HS (thus, as will be described below, the magnitude of a bias voltage applied to the developer 38 held on the surface of the sleeve 40 of the applicator means 34 is changed).

The humidity detector HS can be disposed, for example, upstream of the developing zone 48 and adjacent to the peripheral surface of the rotary drum 2 (therefore, the peripheral surface of the photosensitive member 8) when viewed in the rotating direction shown by arrow 4 of the rotating drum 2. The humidity detector HS may be constructed of an electrical resistance-type humidity detector known per se whose electrical resistance decreases with an increase in the relative humidity of the environmental atmosphere and increases with a decrease in the relative humidity. One of the two terminals of the humidity detector HS is grounded, and the other is connected to an electric circuit constituting the bias voltage control means 50.

The bias voltage control means 50 includes a fixed resistance $R_1$, a variable resistance VR, a fixed resistance $R_2$, an operational amplifier OA, a transistor Tr and a relay RY. The fixed resistance $R_1$ is connected in series to the variable resistance VR, and the connecting point of the two is connected to a first input terminal (+) of the operational amplifier QA. The fixed resistance $R_2$ is connected in series to the humidity detector HS, and the connecting point of the two is connected to a second input terminal (−) of the operational amplifier QA. The output terminal of the operational amplifier QA is connected to the transistor Tr. The relay Ry is connected in series to the transistor Tr so that when the transistor Tr conducts, the relay Ry is energized to open the normally closed switch S.

The developer 12 which is improved as above performs the following operation.

When the relative humidity of the environmental atmosphere is not more than a certain fixed value (for example, 60%), a voltage put into the first input terminal (+) of the operational amplifier OA is not higher than a voltage put into the second input terminal (−) of the operational amplifier OA, and hence, no signal is generated at the output terminal of the operational amplifier OA. Accordingly, the transistor Tr does not conduct and the relay Ry is deenergized to maintain the normally closed switch S in the closed state. In this condition, the voltage from the first fixed voltage supply $E_1$ is applied through the sleeve 40 to the developer 38 which is held on the surface of the sleeve 40, and the voltage from the second dc fixed voltage supply $E_2$ is applied through the brush length setting member 36 to the developer 38 held on the surface of the sleeve 40.

On the other hand, if the relative humidity of the environmental atmosphere exceeds the predetermined value, a voltage put into the first input terminal (+) of the operational amplifier OA becomes higher than a voltage put into the second input terminal (−), and therefore, an output signal is generated at the output terminal of the operational amplifier OA. As a result, the transistor Tr conducts to energize the relay Ry and open the normally closed switch S. Thus, only the voltage from the first dc fixed voltage supply $E_1$ is applied through the sleeve 40 to the developer 38 held on the sleeve 40.

The foresaid predetermined value of the relative humidity of the atmosphere, i.e. the critical value of the relative humidity of the atmosphere at which the normally closed switch S is maintained in the closed state, can be properly adjusted according to the properties of the developer 38 and the photosensitive member 8 by adjusting the resistance value of the variable resistance VR.

In the improved developing device of the invention described hereinabove, therefore, both the voltage from the first dc voltage supply $E_1$ and the voltage from the second dc voltage supply $E_2$ are applied to the developer 38 held on the sleeve 40 when the relative humidity of the atmosphere is not more than the predetermined value and therefore the amount of the electrostatic charge in the image areas and the amount of the residual electrostatic charge in the non-image areas in the latent electrostatic image formed on the photosensitive member 8 are relatively large. On the other hand, when the relative humidity of the atmosphere exceeds the predetermined value and therefore the amount of the electrostatic charge in the image areas and the amount of the residual electrostatic charge in the non-image areas in the latent electrostatic image formed on the photosensitive member 8 are relatively small, only the voltage from the first dc voltage supply $E_1$ is applied to the developer 38 held on the surface of the sleeve 40. Since the magnitude of the bias voltage is thus varied according to the relative humidity of the atmosphere, an excessive decrease or increase of the bias voltage can be avoided. Hence, developed images of good quality can be obtained stably without the occurrence of undesirable phenomena such as fogging and the lack of development even when the relative humidity of the environmental atmosphere varies considerably.

In the illustrated embodiment, a positive bias voltage is applied to the developer 38 on the sleeve 40 because the electrostatic charge on the photosensitive member 8 is of positive polarity. Needless to say, if the electrostatic charge on the photosensitive member 8 is negative, a negative bias voltage should be applied to the developer 38 on the sleeve 40.

In the above-described embodiment, two dc voltage supplies, $E_1$ and $E_2$, are provided for application of a bias voltage to the developer 38 held on the sleeve 40, and the bias voltage is changed in two stages on the basis of the relative humidity of the atmosphere. If desired, it is possible to provide three or more dc fixed voltage supplies and change the bias voltage in three or more stages according to the relative humidity of the atmosphere.

If further desired, the bias voltage can be changed continuously according to changes in the relative humidity of the atmosphere. This can be achieved, for example, by using the electric circuit shown in FIG. 2 instead of the normally closed switch S, the first dc fixed voltage supply $E_1$, the second dc fixed voltage supply $E_2$ and the bias voltage control means 50 shown in FIG. 1.

Figure 2:
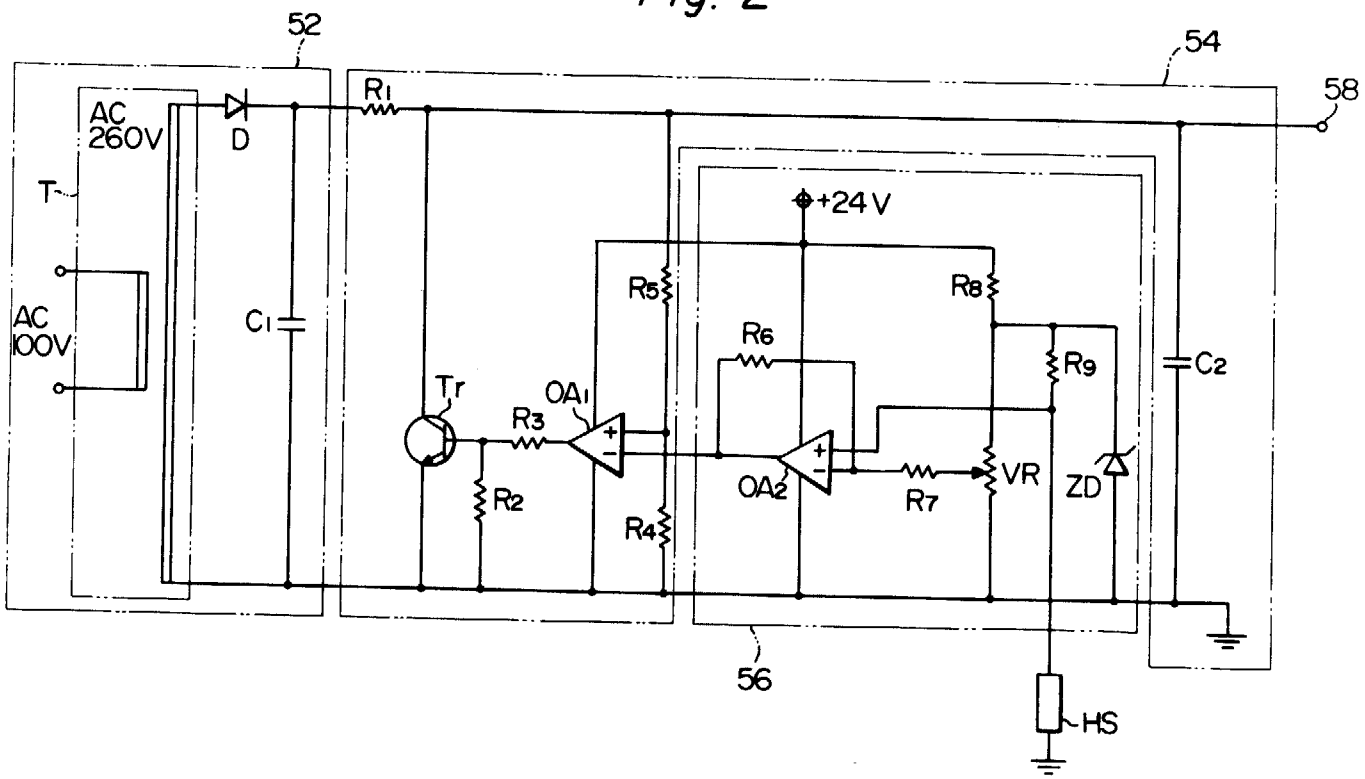
FIG. 2 is an example of an electrical circuit used to change the bias voltage continuously according to changes in the relative humidity of the environmental atmosphere.

The electric circuit shown in FIG. 2 includes a bias voltage supply means 52, a first control means 54 and a second control means 56.

The bias voltage supply means 52 comprises a transformer T, a rectifying diode D and a smoothing condenser $C_1$, and supplies a dc voltage to the first control means 54.

The first control means 54 has resistances $R_1$, $R_2$, $R_3$, $R_4$ and $R_5$, a transistor Tr, a condenser $C_2$, and an operational amplifier $OA_1$. An output terminal 58 of the first control means 54 is connected to the sleeve 40 or the brush length setting member 36 (see FIG. 1). As will be seen from the following description, the voltage of the output terminal 58 is changed continuously according to a voltage put into a second input terminal (−) of the operational amplifier $OA_1$ (i.e., the output voltage of the second control means 56).

The operation of the first control means 54 is summarized below. For convenience of explanation, let us suppose that the voltage put into the second input terminal (−) of the operational amplifier $OA_1$ (i.e., the output voltage of the second control means 56) is constant. If the voltage put into the first input terminal (+) of the operational amplifier $OA_1$ is higher than that put into the second input terminal (−) of the operational amplifier $OA_1$, the voltage at the output terminal of the operational amplifier $OA_1$ increases and therefore the base voltage of the transistor Tr increases. As a result, the voltage between a collector and an emitter decreases. This voltage decrease is distributed between the resistances $R_4$ and $R_5$ to decrease the voltage put into the first input terminal (+) of the operational amplifier $OA_1$. Conversely, if the voltage put into the first input terminal (+) of the operational amplifier $OA_1$ is lower than the voltage put into the second input terminal (−), the voltage at the output terminal of the operational amplifier $QA_1$ decreases and therefore, the base voltage of the transistor Tr decreases. As a result, the voltage between the collector and the emitter increases. This voltage increase is distributed between the resistances $R_4$ and $R_5$ to increase the voltage put into the first input terminal (+) of the operational amplifier $OA_1$. Accordingly, the voltage put into the first input terminal (+) of the operational amplifier $OA_1$ is brought into agreement with the voltage put into the second input terminal (−) of the operational amplifier $OA_1$ and is thus stabilized. The voltage of the output terminal 58 of the first control means 54 (i.e., the bias voltage applied to the developer 38 held on the surface of the sleeve 40) is proportional to the voltage between the collector and emitter of the transistor Tr, and therefore also to the voltage of the connecting point between the resistances $R_4$ and $R_5$.

When the output voltage of the second control means 56 increases and the voltage put into the second input terminal (−) of the operational amplifier $OA_1$ increases, the voltage at the output terminal of the operational amplifier $OA_1$ decreases and therefore the base voltage of the transistor Tr decreases to increase the voltage between the collector and the emitter. This voltage increase is distributed between the resistances $R_4$ and $R_5$, whereby the voltage put into the first input terminal (+) of the operational amplifier $OA_1$ increases. Thus, the voltage put into the first input terminal (+) of the operational amplifier $OA_1$ increases to a value corresponding with the voltage put into the second input terminal (−). It will be seen therefore that when the voltage put into the second input terminal (−) of the operational amplifier $OA_1$ increases, the voltage put into the first input terminal (+), i.e. the voltage of the connecting point between the resistances $R_4$ and $R_5$, increases, the therefore, the voltage at the output terminal 58 of the first control means 54 increases. Conversely, when the output voltage of the second control means 56 decreases and the voltage put into the second input terminal (−) of the operational amplifier $OA_1$ decreases, the voltage at the output terminal of the operational amplifier $OA_1$ increases and therefore the base voltage of the transistor Tr increases to decrease the voltage between the collector and the emitter. This voltage decrease is distributed between the resistances $R_4$ and $R_5$ and therefore, the voltage put into the first input terminal (+) of the operational amplifier $OA_1$ decreases. Thus, the voltage put into the first input terminal (+) of the operational amplifier $OA_1$ decreases to a value corresponding with the voltage put into the second input terminal (−). It will be seen that when the voltage put into the second input terminal (−) of the operational amplifier $OA_1$ decreases in this way, the voltage put into the first input terminal (+), i.e. the voltage of the connecting point between the resistances $R_4$ and $R_5$, also decreases, and therefore, the voltage of the output terminal 58 of the first control means 54 decreases.

The second control means 56 comprises resistances $R_6$, $R_7$, $R_8$ and $R_9$, a variable resistance VR, a Zener diode ZD and an operational amplifier $OA_2$. To the second control means 56 is connected the humidity detector HS (see FIG. 1 also) for detecting the relative humidity of the environmental atmosphere.

The operation of the second control means 56 is described below briefly. A voltage between the two terminals of the humidity detector HS is put into a first input terminal (+) of the operational amplifier $OA_2$, and a predetermined voltage set by the variable resistance VR is put into a second input terminal (−) of the operational amplifier $QA_2$. At the same time, the voltage at the output terminal of the operational amplifier $OA_2$ is fed back through the resistance $R_6$. The voltage of the output terminal of the operational amplifier $OA_2$ is stabilized when the voltage put into the first input terminal (+) is equal to the voltage put into the second input terminal (−). When the relative humidity of the atmosphere decreases and the resistance of the humidity detector HS increases, the voltage put into the first input terminal (+) of the operational amplifier $OA_2$ increases. As a result, the voltage of the output terminal of the operational amplifier $OA_2$ increases. At the same time, since the voltage of the output terminal is fed back to the second input terminal (−) through the resistance $R_6$, the voltage of the second input terminal (−) increases. The voltage of the output terminal of the operational amplifier $OA_2$ becomes stable after it has increased until the voltage of the first input terminal (+)

becomes equal to the voltage of the second input terminal (−). Conversely, when the relative humidity of the atmosphere rises and the resistance of the humidity detector HS decreases, the voltage put into the first input terminal (+) of the operational amplifier $OA_2$ decreases. As a result, the voltage at the output terminal of the operational amplifier $OA_2$ decreases. At the same time, since the voltage of the output terminal is fed back to the second input terminal (−) through the resistance $R_6$, the voltage of the second input terminal (−) also decreases. The voltage of the output terminal of the operational amplifier $OA_2$ becomes stable after it has decreased until the voltage of the first input terminal (+) becomes equal to the voltage of the second input terminal (−). The voltage of the output terminal of the operational amplifier $OA_2$ corresponding to the resistance value of the humidity detector HS, i.e. the output voltage of the second control means 56, can be adjusted as desired by adjusting the resistance of the variable resistance VR.

It will be apparent from the foregoing statement that according to the electric circuit shown in FIG. 2, the bias voltage, i.e, the voltage of the output terminal 58 of the first control means 54, can be continuously changed according to changes in the relative humidity of the atmosphere. When the relative humidity of the atmosphere decreases to increase the resistance of the humidity detector HS, the output voltage of the second control means 56 (i.e., the voltage of the output terminal of the operational amplifier $OA_2$) increases, and thus the bias voltage is increased. Conversely, when the relative humidity of the atmosphere increases to decrease the resistance value of the humidity detector HS, the output voltage of the second control means 56 decreases to decrease the bias voltage.

While the embodiment of the latent electrostatic image developing device constructed in accordance with this invention has been described hereinabove with reference to the specific embodiments shown in the accompanying drawings, it should be understood that the present invention is not limited to such specific embodiments, and various changes and modifications are possible without departing from the scope of the invention.

In the foregoing description, the invention has been explained with reference to a developing device for developing a latent electrostatic image formed on a photosensitive member. The present invention can also be applied to those developing devices which are used to develop a latent electrostatic image transferred to a copy sheet from the photosensitive member, or a latent electrostatic image formed directly on a copy sheet having photosensitive properties.

Furthermore, although the present invention has been described hereinabove with reference to a latent electrostatic image developing device which uses a one-component developer consisting only of conductive or semiconductive magnetic toner particles, it should be noted that the present invention can also be applied to those latent electrostatic image developing devices which use various other developers, for example a one-component developer composed only of insulating magnetic toner particles, a one-component developer composed only of non-magnetic toner particles, or a two-component developer composed of toner particles and carrier particles.

EXAMPLES

Using an electrostatic copying machine of the type shown in FIG. 1, a copying operation was performed through 1000 cycles in an atmosphere having a relative humidity of 18%, 49%, 58%, and 89%, respectively, as detected by the humidity detector. The details of the main constituent elements of the copying machine were as follows:

| | |
|---|---|
| Material of the photosensitive member 8: | selenium |
| Magnetic field strength at the surface of the sleeve 40: | about 900 gauss |
| Developer 38: | one-component developer composed only of toner particles |
| Volume resistivity of the toner particles: | $3.2 \times 10^{14}$ ohms-cm |
| Average electrostatic capacity of the toner particles: | 7.4 PF |
| Average dielectric constant of the toner particles: | 3.7 |
| Particle size distribution of the toner particles: | 5-25 microns |
| Distance between the tip of the brush length setting member 36 and the surface of the sleeve 40: | 0.3 mm |
| Distance between the sleeve 40 and the photosensitive member 8: | 0.5 mm |
| Charging corona discharge device 10: | +6.7 KV |
| Transferring corona discharge device 14: | +6.3 KV |
| Charge-eliminating corona discharge device 16: | ±4.0 KV |
| Copy Sheet: | High quality paper having a thickness of 80 microns |
| First dc fixed voltage supply $E_1$: | 125 V |
| Second dc fixed voltage supply $E_2$: | 250 V |
| Opening and closing of the Switch S: | Closed when the relative humidity of the atmosphere is not more than 60%, and open when it exceeds 60%. |

Under the four different humidity conditions mentioned above, the density of the image areas and the density of the non-image areas (fog density) of the copies obtained in the first and last (1,000th) cycles of copying operation were measured. The results are shown in Table 1.

COMPARATIVE EXAMPLES

The Examples were repeated except that the switch S was open at a relative humidity of 18%, or the switch S was closed at a relative humidity of 89%. The densities of the copies obtained in the first and 1,000th cycles of copying operations in the image and non-image areas were measured as in the Examples. The results are shown in Table 1.

TABLE 1

| | Relative humidity (%) | Bias voltage (V) | Copying cycle | Density: Image-areas | Density: Non-Image-areas | Evaluation |
|---|---|---|---|---|---|---|
| Example 1 | 18 | 125 + 250 | 1st | 1.46 | 0.11 | Good |
| | | | 1000th | 1.44 | 0.12 | Good |
| Example 2 | 49 | 125 + | 1st | 1.45 | 0.11 | Good |

TABLE 1-continued

| | Relative humidity (%) | Bias voltage (V) | Copying cycle | Density: Image-areas | Density: Non-Image-areas | Evaluation |
|---|---|---|---|---|---|---|
| | | 250 | 1000th | 1.48 | 0.11 | Good |
| Example 3 | 58 | 125 + 250 | 1st | 1.47 | 0.11 | Good |
| | | | 1000th | 1.45 | 0.11 | Good |
| Example 4 | 89 | 125 | 1st | 1.33 | 0.11 | Good |
| | | | 1000th | 1.28 | 0.11 | Good |
| Comparative Example 1 | 18 | 125 | 1st | 1.34 | 0.13 | Good |
| | | | 1000th | 1.41 | 0.22 | Heavy fogging |
| Comparative Example 2 | 89 | 125 + 250 | 1st | 1.14 | 0.11 | Lack of development |
| | | | 1000th | 1.08 | 0.11 | Lack of development |

What we claim is:

1. In a latent electrostatic image developing device for developing a latent electrostatic image formed on an image-bearing member by applying a developer thereto, said developing device comprising developer applicator means for holding developer on the surface thereof, carrying the developer to a developing zone and applying it to a latent electrostatic image in the developing zone and bias voltage applying means for applying a bias voltage to the developer held on the surface of the developer applicator means; the improvement wherein the bias voltage applying means comprises a first dc fixed voltage supply and a second dc fixed voltage supply and wherein the developing device further includes detector means for detecting the relative humidity of the environmental atmosphere and control means for connecting both the first and the second dc fixed voltage supplies to the developer held on the developer applicator means to adjust the applied bias voltage to a first value when the detected relative humidity is less than a predetermined value, and connecting only the first dc fixed voltage supply to the developer held on the developer applicator means to adjust the applied bias voltage to a second value less than the first value when the detected relative humidity exceeds the predetermined value.

2. The device of claim 1 which further includes a brush length setting member for setting the thickness of a layer of the developer held on the surface of the developer applicator means at a predetermined value, said brush length setting member having a tip located in proximity to the surface of the developer applicator means, and in which said image-bearing member is grounded, the first dc voltage supply is connected between said developer applicator means and the ground, the second dc fixed voltage supply is connected via a switch between the brush length setting member and the ground, and said bias voltage control means closes said switch when the detected relative humidity is not more than the predetermined value and opens it when the detected relative humidity exceeds the predetermined value.

3. The device of claim 1 or 2 wherein the predetermined value of the relative humidity is about 60%.

4. In a latent electrostatic image developing device for developing a latent electrostatic image formed on an image-bearing member by applying a developer thereto, said developing device comprising developer applicator means for holding developer on the surface thereof, carrying the developer to a developing zone and applying it to a latent electrostatic image in the developing zone and bias voltage applying means for applying a bias voltage to the developer held on the surface of the developer applicator means; the improvement wherein said bias voltage applying means includes a dc voltage supply whose voltage value can be varied continuously and wherein the developing device further includes detector means for detecting the relative humidity of the environmental atmosphere and control means for varying the bias voltage continuously according to changes in the relative humidity of the atmosphere in such a manner that said bias voltage control means decreases the bias voltage when the relative humidity of the atmosphere has increased and increases the bias voltage when the relative humidity of the atmosphere has decreased.

* * * * *